US010655471B2

(12) United States Patent
Iida et al.

(10) Patent No.: US 10,655,471 B2
(45) Date of Patent: May 19, 2020

(54) TURBINE AND GAS TURBINE

(71) Applicant: MITSUBISHI HITACHI POWER SYSTEMS, LTD., Kanagawa (JP)

(72) Inventors: Koichiro Iida, Tokyo (JP); Norifumi Hirata, Yokohama (JP)

(73) Assignee: MITSUBISHI HITACHI POWER SYSTEMS, LTD., Kanagawa (JP)

( * ) Notice: Subject to any disclaimer, the term of this patent is extended or adjusted under 35 U.S.C. 154(b) by 309 days.

(21) Appl. No.: 15/548,188

(22) PCT Filed: Feb. 10, 2016

(86) PCT No.: PCT/JP2016/053925
§ 371 (c)(1),
(2) Date: Aug. 2, 2017

(87) PCT Pub. No.: WO2016/129628
PCT Pub. Date: Aug. 18, 2016

(65) Prior Publication Data

US 2018/0030835 A1 Feb. 1, 2018

(30) Foreign Application Priority Data

Feb. 10, 2015 (JP) ..... 2015-024441

(51) Int. Cl.
*F01D 5/14* (2006.01)

(52) U.S. Cl.
CPC ..... *F01D 5/141* (2013.01); *F01D 5/14* (2013.01); *F01D 5/145* (2013.01); *F05D 2240/30* (2013.01)

(58) Field of Classification Search
CPC ... F01D 5/06; F01D 5/14; F01D 5/141; F01D 5/142; F01D 5/145; F04D 29/324;
(Continued)

(56) References Cited

U.S. PATENT DOCUMENTS 907,981 A * 12/1908 De Ferranti ..... F01D 5/225
415/173.6
995,367 A * 6/1911 Patitz ..... F01D 5/06
416/201 R (Continued)

FOREIGN PATENT DOCUMENTS

GB 868100 A * 5/1961 ..... F01D 5/142
JP 2004-278517 10/2004

(Continued)

OTHER PUBLICATIONS

International Search Report dated Apr. 26, 2016 in International Application No. PCT/JP2016/053925.

(Continued)

*Primary Examiner* — Kenneth J Hansen
*Assistant Examiner* — Maranatha Boardman
(74) *Attorney, Agent, or Firm* — Wenderoth, Lind & Ponack, L.L.P.

(57) ABSTRACT

A flow path width at a hub endwall of a blade main body decreases toward a minimum width from a leading edge, and increases toward a trailing edge from the minimum width, the flow path width at a reference blade height aparted toward a tip side from the hub endwall of the blade main body gradually decreases toward the trailing edge from the leading edge, and an axial chord length position of the minimum flow path widths at respective blade height shift toward a transition to the trailing edge side from the hub endwall toward the tip side of the blade main body and coincides with the trailing edge at the reference blade height.

6 Claims, 6 Drawing Sheets

(58) Field of Classification Search
CPC .... F04D 29/38; F04D 29/384; F05D 2220/32; F05D 2220/31; F05D 2210/31; F05D 2210/30; F05D 2240/305; F05D 2240/306; F05D 2240/307
USPC ..... 416/223 A, 243, DIG. 2, DIG. 5
See application file for complete search history.

(56) References Cited

U.S. PATENT DOCUMENTS 1,050,119 A * 1/1913 Flanders ..... F01D 5/3023 416/220 R
1,548,613 A * 8/1925 Kieser ..... F01D 5/141 416/243
1,673,554 A * 6/1928 Frey ..... F01D 5/14 415/191
1,749,528 A * 3/1930 De Freudenreich et al. ..... F01D 5/14 416/248
2,258,793 A * 10/1941 New ..... F01D 5/142 415/194
3,347,520 A * 10/1967 Oweczarek ..... F01D 5/14 415/119
3,475,108 A * 10/1969 Zickuhr ..... F01D 5/141 415/194
3,652,182 A * 3/1972 Deich ..... F01D 25/32 415/169.4
4,626,174 A * 12/1986 Sato ..... F01D 5/141 415/181
4,809,498 A * 3/1989 Giffin, III ..... B64C 11/48 416/129
4,968,216 A * 11/1990 Anderson ..... F01D 1/16 415/181
5,203,676 A * 4/1993 Ferleger ..... F01D 5/141 416/191
5,221,181 A * 6/1993 Ferleger ..... F01D 5/141 415/181
5,277,549 A * 1/1994 Chen ..... F01D 5/141 415/181
5,326,221 A * 7/1994 Amyot ..... F01D 5/141 415/191
5,352,092 A * 10/1994 Ferleger ..... F01D 5/141 416/223 A
6,036,438 A * 3/2000 Imai ..... F01D 5/142 415/192
6,491,493 B1 12/2002 Watanabe et al.
6,779,973 B2 * 8/2004 Ito ..... F01D 5/141 415/191
7,048,509 B2 * 5/2006 Tominaga ..... F01D 5/14 416/223 A
7,740,449 B1 * 6/2010 Brown ..... F01D 9/041 415/1
8,167,548 B2 * 5/2012 Greim ..... F01D 5/141 415/193
8,821,107 B2 * 9/2014 Lamarque ..... F01D 3/00 415/1
8,967,959 B2 * 3/2015 Stein ..... F01D 5/141 415/192
9,303,656 B2 * 4/2016 Takahashi ..... F04D 29/324
9,695,694 B2 * 7/2017 Huebner ..... F01D 5/141
9,719,354 B2 * 8/2017 Kitagawa ..... F01D 5/141
9,957,804 B2 * 5/2018 Chouhan ..... F01D 5/141
9,957,805 B2 * 5/2018 Soni ..... F01D 5/145
9,963,985 B2 * 5/2018 Chouhan ..... F01D 9/041
2002/0085918 A1 * 7/2002 Olhofer ..... F01D 5/141 416/223 A
2004/0081548 A1 4/2004 Zess et al.
2009/0257866 A1 * 10/2009 Greim ..... F01D 5/141 415/208.1
2012/0189441 A1 7/2012 Haller et al.
2014/0041395 A1 2/2014 Kitagawa et al.

FOREIGN PATENT DOCUMENTS

JP 3986798 10/2007
JP 2010-203259 9/2010
JP 2012-154332 8/2012
JP 2012-207648 10/2012
JP 2015-017615 1/2015

OTHER PUBLICATIONS

Written Opinion of the International Searching Authority dated Apr. 26, 2016 in International Application No. PCT/JP2016/053925.

* cited by examiner

TURBINE AND GAS TURBINE

BACKGROUND OF THE INVENTION

1. Technical Field

The present invention relates to a turbine and a gas turbine.

Priority is claimed on Japanese Patent Application No. 2015-024441, filed on Feb. 10, 2015, the content of which is incorporated herein by reference.

2. Description of the Related Art

It is preferable to increase a profile thickness near the middle of a hub endwall of a blade main body in a flow direction in order to improve the strength of a rotating turbine blade (on which a centrifugal force acts), which results in an increase in the efficiency and temperature of a gas turbine. Japanese Unexamined Patent Application, First Publication No. 2010-203259, for example, discloses a blade structure in which a fillet portion for improving the strength of a blade main body is disposed at a hub endwall.

In turbines, in general, the width of a flow path between neighboring blade main bodies monotonically decreases toward a downstream side and is minimized at trailing edges of blades for a combustion gas to be accelerated through the flow path between the main bodies of the neighboring blades.

SUMMARY OF THE INVENTION

1. Technical Problem

In a case where the profile thickness near the middle of the hub endwall of the blade main body in the flow direction is increased as described above, a position where the flow path width is minimized is positioned upstream of the trailing edge at the hub endwall. In this case, the flow path width undergoes a transition from shrinkage to expansion near the middle in the flow direction at the hub endwall, and this leads to deterioration in terms of flow velocity distribution on a blade surface. More specifically, rapid deceleration occurs in the middle of a blade back face (a suction side surface), and it results in a decline in performance.

The present invention has been made in view of such circumstances, and an object thereof is to provide a turbine that is capable of suppressing a decline in efficiency while improving strength and a gas turbine that includes the turbine.

2. Technical Solution

According to a first aspect of the present invention, a turbine includes a plurality of blades having blade main bodies extending radially outwards from an axis, a flow path being formed between the neighboring blade main bodies by the blades being arranged in a circumferential direction of the axis. A width of the flow path at a hub endwall of the blade main body decreases toward a minimum width from a leading edge, and increases toward a trailing edge from the minimum width, the minimum width is located between the leading edge and the trailing edge. The flow path width at a reference blade height separated toward a tip side from the hub endwall of the blade main body gradually decreases toward the trailing edge from the leading edge. An axial chord length position of the minimum flow path widths at respective blade height shift toward the trailing edge side from the hub endwall toward the tip side of the blade main body and coincides with the trailing edge at the reference blade height.

According to this configuration, the flow path width is narrowed on the trailing edge side of the reference blade height and the flow path width expands on the trailing edge side of the hub endwall. As a result, on the trailing edge side, three-dimensional flow rate redistribution is performed for a flow to be induced from the reference blade height side to the hub endwall side. Because the flow is supplied toward the hub endwall as described above, a rapid decline in flow velocity on a blade back face on the hub endwall side can be suppressed.

According to a second aspect of the present invention, in the turbine according to the first aspect described above, the reference blade height may be located between 5% and 25% of a blade height toward the tip side from the hub endwall.

In the region that falls below 5% of the blade height to the tip side from the hub endwall, a profile thickness near the middle of an axial chord length is increased for the strength of the blade to be ensured. Accordingly, the reference blade height is in the region of at least 5% of the blade height. If the reference blade height is positioned in the region exceeding 25% of the blade height, the reference blade height will be excessively separated from the hub endwall. Then, effective flow induction from the reference blade height toward the hub endwall will be impossible.

According to this configuration, however, the reference blade height is set within the range described above, and thus the strength of the blade can be ensured and induction of a flow to the hub endwall can be effectively performed at the same time.

According to a third aspect of the present invention, in the turbine according to the first or second aspect described above, the blade height at a transition position may be positioned in a region within 10% of the blade height toward the tip side from the hub endwall when the flow path width at each of the blade heights on the trailing edge of the blade main body is defined as a trailing edge flow path width, the flow path width at each of the blade heights at the axial position which is a fraction of the axial chord is the same as the fraction of the axial chord which gives the minimum width at the hub endwall of the blade main body is defined as a hub throat position flow path width. The ratio of the trailing edge flow path width to the hub throat position flow path width at each of the blade heights is defined as the flow path width ratio, and the blade height where a value of the flow path width ratio gradually decreases toward the tip side from a hub side reaches 1 is defined as the transition position.

At a blade height where the value of the flow path width ratio exceeds 1, the trailing edge side expands, and thus the flow rate for maintaining the flow velocity becomes insufficient on the trailing edge side. At a blade height where the value of the flow path width ratio falls below 1, the trailing edge side shrinks, and thus the flow rate is sufficient on the trailing edge side. Accordingly, on the trailing edge side, the flow at the blade height where the value of the flow path width ratio falls below 1 can be induced to the blade height where the value of the flow path width ratio exceeds 1. By the blade height at the transition position where the value of the flow path width ratio is 1 being set in a region within 10% of the blade height, the flow can be effectively induced to the blade height where the flow rate is insufficient on the trailing edge side.

According to a fourth aspect of the present invention, in the turbine according to the third aspect described above, a relationship of $|\beta-1|>|\alpha-1|$ may be established when the maximum value of the flow path width ratio in the region within 10% of the blade height toward the tip side from the hub endwall is defined as the maximum flow path width ratio $\alpha$ and the minimum value of the flow path width ratio in a region within 20% of the blade height toward the tip side from the hub endwall is defined as the minimum flow path width ratio $\beta$.

By the absolute value of the difference between the minimum flow path width ratio $\beta$ and 1 exceeding the absolute value of the difference between the maximum flow path width ratio $\alpha$ and 1, the flow can be effectively induced to the blade height where the flow rate is insufficient on the trailing edge side.

According to a fifth aspect of the present invention, in the turbine according to the third or fourth aspect described above, a relationship of B>A may be established between A and B when a curve is created regarding a change in the flow path width ratio with a horizontal axis X regarded as the flow path width ratio and a vertical axis Y regarded as a percentage distance of blade height [%] toward the tip side from the hub side with respect to the blade height, A being an area of a first region surrounded by the curve X=1 and Y=0[%] and B being an area of a second region surrounded by the curve X=1 and Y=20[%].

By this relationship being established, the flow can be effectively induced to the blade height on the trailing edge side where the flow rate is insufficient.

According to a sixth aspect of the present invention, a gas turbine includes a compressor generating compressed air by compressing air, a combustor generating a combustion gas by combusting the compressed air with a fuel, and the turbine according to any one of the first to fifth aspects driven by the combustion gas.

According to an eighth aspect of the present invention, a turbine blade constitutes a plurality of the turbine blades forming a flow path between the neighboring turbine blades by being arranged in a circumferential direction of a rotor. A width of the flow path at a hub endwall of the turbine blade decreases toward a minimum width from a leading edge, and increases toward a trailing edge from the minimum width, the minimum width is located between the leading edge and the trailing edge. The flow path width at a reference blade height separated toward a tip side from the hub endwall of the turbine blade gradually decreases toward the trailing edge from the leading edge. An axial chord length position of the minimum flow path widths at respective blade height shift toward the trailing edge side from the hub endwall toward the tip side of the turbine blade and coincides with the trailing edge at the reference blade height.

According to this configuration, the flow path width is narrowed down on the trailing edge side of the reference blade height and the flow path width expands on the trailing edge side of the hub endwall. As a result, on the trailing edge side, three-dimensional flow rate redistribution is performed for a flow to be induced from the reference blade height side to the hub endwall side. Because the flow is supplied toward the hub endwall as described above, a rapid decline in flow velocity on a blade back face on the hub endwall side can be suppressed.

3. Advantageous Effects of the Invention

According to the configuration described above, a decline in efficiency can be suppressed by a rapid deceleration on a blade back face of a hub side end face being suppressed.

DETAILED DESCRIPTION OF EMBODIMENTS OF THE INVENTION

Hereinafter, a gas turbine that is provided with a turbine according to a first embodiment of the present invention will be described with reference to FIGS. 1 to 6.

Figure 1:
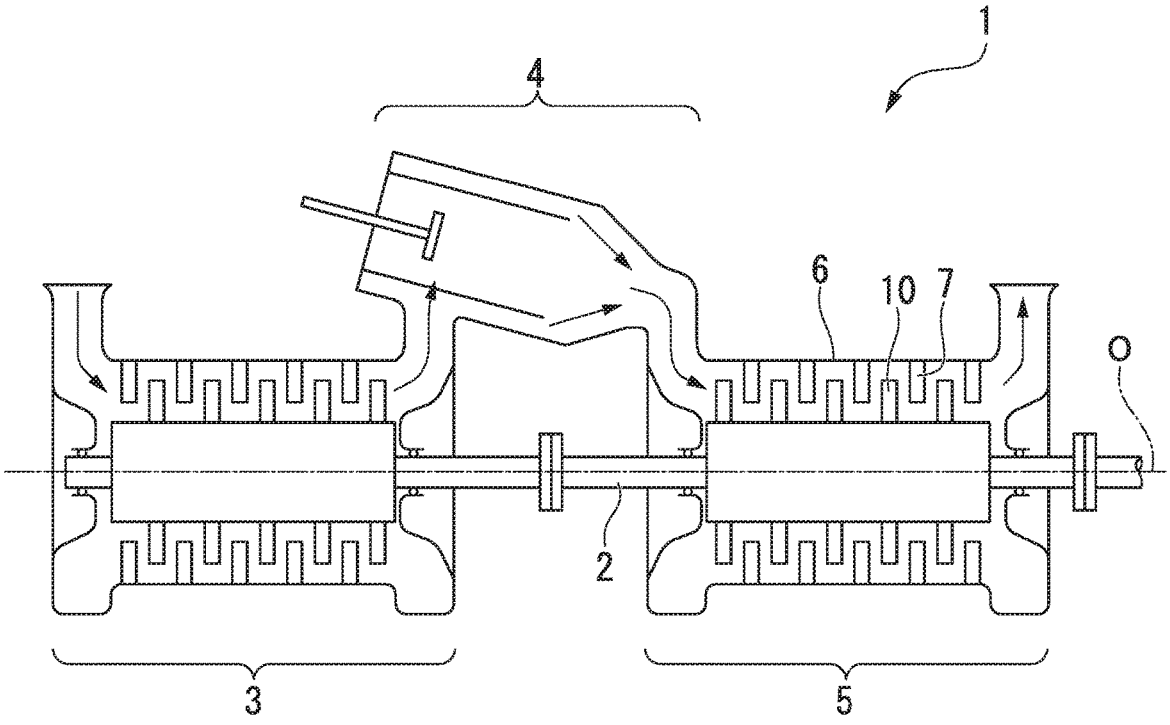
FIG. 1 is an overall schematic diagram of a gas turbine according to a first embodiment of the present invention.

As shown in FIG. 1, a gas turbine 1 is provided with a compressor 3, a combustor 4, a turbine 5, and a rotor 2. The compressor 3 generates compressed air by taking in air and compressing it. The combustor 4 generates a combustion gas by mixing a fuel with the compressed air generated by the compressor 3 and combusting the mixture. The combustion gas generated by the combustor 4 is introduced into the turbine 5, and the turbine 5 is turned by the thermal energy of the combustion gas being converted into rotational energy. The rotor 2, which is rotatable about an axis O, takes out power turning the turbine 5 to the outside and turns the compressor 3 by transmitting some of the power to the compressor 3.

The turbine 5 converts the thermal energy of the combustion gas into the mechanical rotational energy and generates power by spraying the combustion gas to blades 10 (turbine blades) disposed on the rotor 2. The turbine 5 is provided with not only the plurality of blades 10 on the rotor side but also a plurality of vanes 7 on a side of a casing 6. The blades 10 and the vanes 7 are alternately arranged in an axial direction of the rotor 2.

The blades 10 allow the rotor 2 to rotate about the axis O in response to the pressure of the combustion gas flowing in the direction of the axis O of the rotor 2. The rotational energy given to the rotor 2 is used after being taken out from an axial end.

Hereinafter, the blades 10 of the turbine 5 will be described in more detail.

Figure 2:
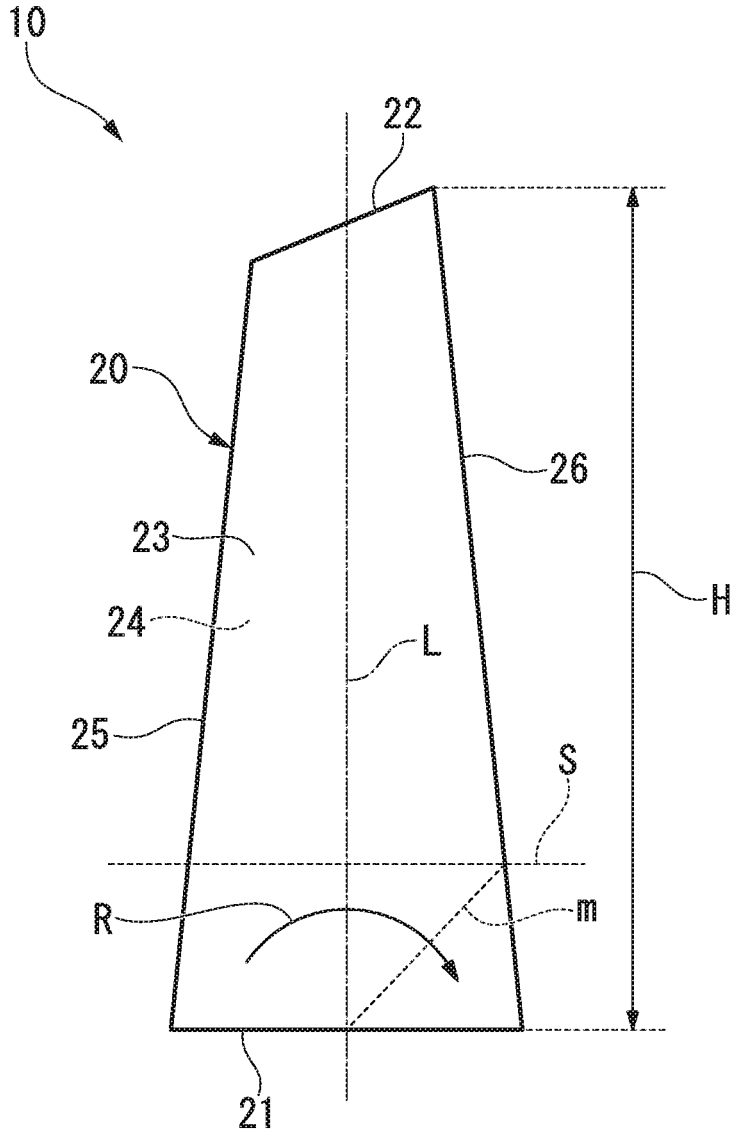
FIG. 2 is a schematic side view of a blade main body of a blade of the turbine according to the first embodiment of the present invention.

As shown in FIG. 2, the blade 10 has a blade main body 20 extending outwards from the rotor 2 in a radial direction of the axis O. A platform (not shown) and a blade root (not shown) are disposed on a base end side of the blade main body 20, that is, on the rotor side. The blade 10 is firmly fixed to the rotor 2 by the blade root being fitted into a disk (not shown) that is integrally formed with the rotor 2.

Hereinafter, an inside end portion of the blade main body 20 in its radial direction (portion connected to the platform) will be referred to as a hub endwall 21, and an outside end portion of the blade main body 20 in its radial direction will be referred to as a tip 22. In the blade main body 20, the maximum dimension in the radial direction of the axis O from the hub endwall 21 to the tip 22 is a blade height H. In addition, each position in the blade main body 20 in its radial direction is a blade height. In the following description, the blade height of the blade main body 20 at a time when the blade height at the hub endwall 21 is 0% and the blade height at the outermost diameter dimension of the tip 22 is 100% will be defined as a percentage distance of blade height. According to this definition, the blade height that is, for example, just in the middle between the hub endwall 21 and the tip 22 of the blade main body 20 has a percentage distance of blade height of 50%.

Figure 3:
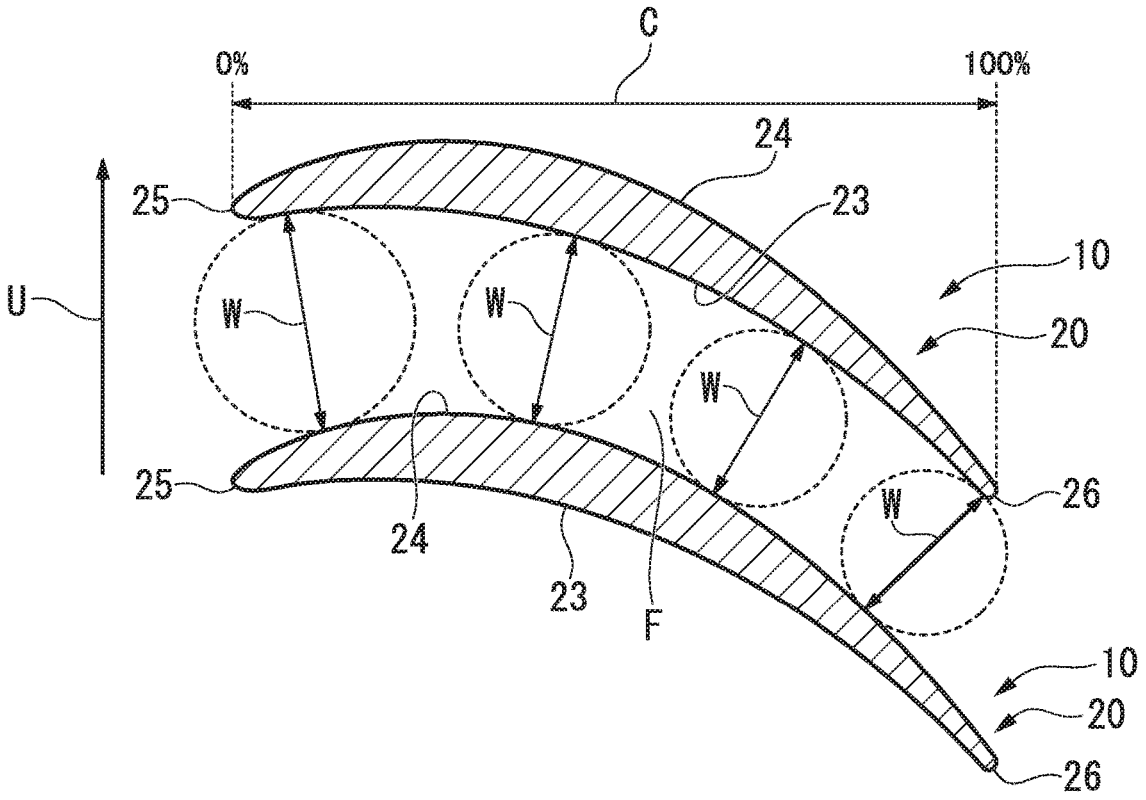
FIG. 3 is a sectional view showing a flow path between the neighboring blades of the turbine according to the first embodiment of the present invention, which is orthogonal to a blade height direction.

As shown in FIG. 3, a surface of the blade main body 20 toward the back in a direction of rotation U of the rotor 2 is a pressure side surface 23 bending toward the front in the direction of rotation U. A surface of the blade main body 20 toward the front in the direction of rotation U of the rotor 2 is a suction side surface 24 bending toward the front in the direction of rotation U. The blade main body 20 has a blade shape that allows the pressure side surface 23 and the suction side surface 24 to be connected to each other at a leading edge 25 and a trailing edge 26 of the blade main body 20. Both the width of the pressure side surface 23 in the axis O direction and the width of the suction side surface 24 in the axis O direction gradually decrease toward the tip 22 from the hub endwall 21. The leading edge 25 extending all over in a blade height direction is a ridgeline that is formed by the pressure side surface 23 and the suction side surface 24 being connected to each other on an upstream side in the axis O direction, and the trailing edge 26 extending all over in the blade height direction is a ridgeline that is formed by the pressure side surface 23 and the suction side surface 24 being connected to each other on a downstream side in the axis O direction.

In this blade main body 20, a gap between the leading edge 25 and the trailing edge 26 in the axis O direction is an axial chord length C. Each position in the blade main body 20 in the axis O direction is an axial chord length position. In the following description, the axial chord length position of the blade main body 20 at a time when the axial chord length position at the leading edge 25 is 0% and the axial chord length position at the trailing edge 26 is 100% at each blade height will be defined as a percentage distance of axial chord. According to this definition, the axial chord length position that is, for example, just in the middle between the leading edge 25 and the trailing edge 26 of the blade main body 20 has a percentage distance of axial chord of 50%.

The plurality of blades 10 that has these blade main bodies 20 is disposed at equidistant intervals in a circumferential direction of the axis O. As shown in FIG. 3, a flow path F is defined between the blade main bodies 20 of the neighboring blades 10, and the combustion gas flows from the upstream side toward the downstream side through the flow path F.

As shown in FIG. 3, a flow path width W, which is the width of the flow path F formed between the blade main bodies 20, changes over an axial chord length direction. In a case where a virtual circle that is tangent to each of the pressure side surface 23 and the suction side surface 24 of the blade main bodies 20 neighboring each other in the circumferential direction is drawn, the flow path width W is equivalent to the diameter of the virtual circle. The axial chord length position and the flow path width W are associated with each other in a correspondence relationship such that the diameter of the virtual circle at the axial chord length position at a point of contact between the pressure side surface 23 and the virtual circle is the flow path width W at an axial chord length position at that point of contact. Accordingly, the diameter of the virtual circle that is tangent to the trailing edge 26 of the pressure side surface 23 is the flow path width W at the trailing edge 26, that is, the flow path width W at percentage distance of axial chord 100%, as shown in FIG. 3.

Figure 4:
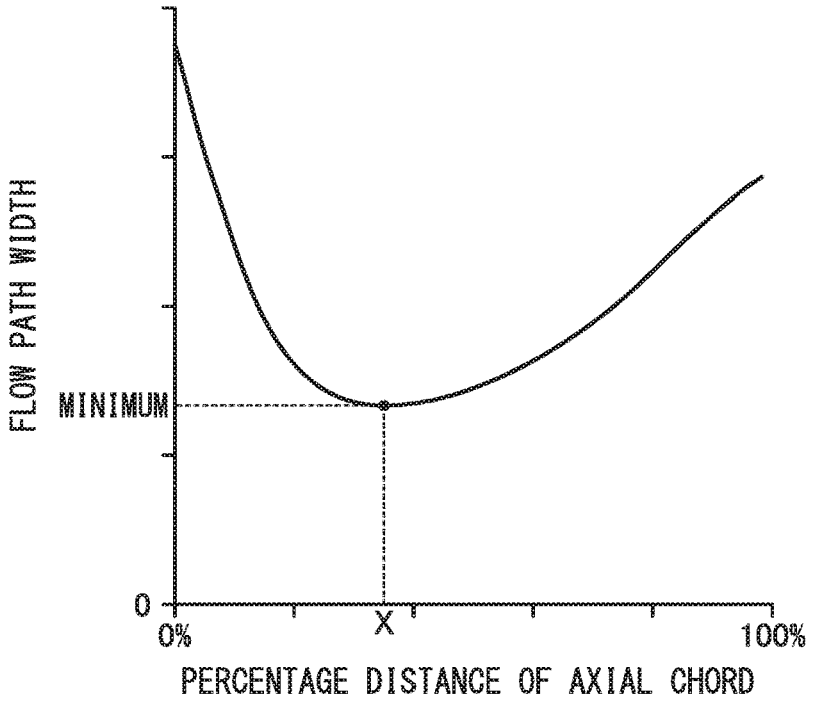
FIG. 4 is a graph showing a relationship between a percentage distance of axial chord and a flow path width at percentage distance of blade height 0% of the turbine according to the first embodiment of the present invention.

The flow path F extends such that its shape continuously changes over the radial direction of the axis O of the blade main body 20, that is, all over the blade height direction of the blade main body 20. The flow path width W at percentage distance of blade height 0%, that is, the flow path width W at the hub endwall 21, changes in the form of the curve that is shown in FIG. 4. In other words, the flow path width W at the hub endwall 21 monotonically decreases from the leading edge 25 (percentage distance of axial chord 0%) as the percentage distance of axial chord increases, and shows an infinitesimal value (minimum value) near percentage distance of axial chord 30%. Then, it monotonically increases as the percentage distance of axial chord increases, and reaches the trailing edge 26 (percentage distance of axial chord 100%). The flow path width W at the trailing edge 26 is smaller than the flow path width W at the leading edge 25. The change in the flow path width W at the hub endwall 21 is not limited to the monotonic decrease and increase described above, and a region of no change may be present in the middle. Alternatively, it may increase after showing an infinitesimal value and decrease again near the trailing edge 26 alone.

Furthermore, the degree of the change in the flow path width W during the monotonic decrease preceding the showing of the infinitesimal value exceeds the degree of the change following the showing of the infinitesimal value. As described above, at the hub endwall 21, the flow path width W reaches the trailing edge 26 while expanding after the flow path width W shrinks to the trailing edge 26 side from the leading edge 25 side and temporarily shows the minimum value.

At the percentage distance of axial chord where the flow path width W is small, a profile thickness increases to the same extent. The hub endwall 21 has a part where the profile thickness is large between the leading edge 25 and the trailing edge 26 for the strength of the blade main body 20 to be improved. Accordingly, a part where the flow path width W is infinitesimal (i.e. a minimum width) is located between the leading edge 25 and the trailing edge 26.

In the present embodiment, the axial chord length position where the flow path width W shows the minimum value (line of minimum flow path width position m shown in FIG. 2) undergoes a transition to the trailing edge 26 side from the hub endwall 21 toward the tip 22, that is, as the percentage distance of blade height increases. Then, the axial chord length position where the flow path width W shows the minimum value reaches 100% at a predetermined blade height, that is, the axial chord length position coincides with the trailing edge 26. In the following description, the blade height where the axial-direction chord length direction position where the flow path width W shows the minimum value coincides with the trailing edge 26 for the first time after undergoing the transition to the trailing edge side with the increase in the percentage distance of blade height will be defined as a reference blade height S. In the present embodiment, the reference blade height S is the percentage distance of blade height 25% position.

Figure 5:
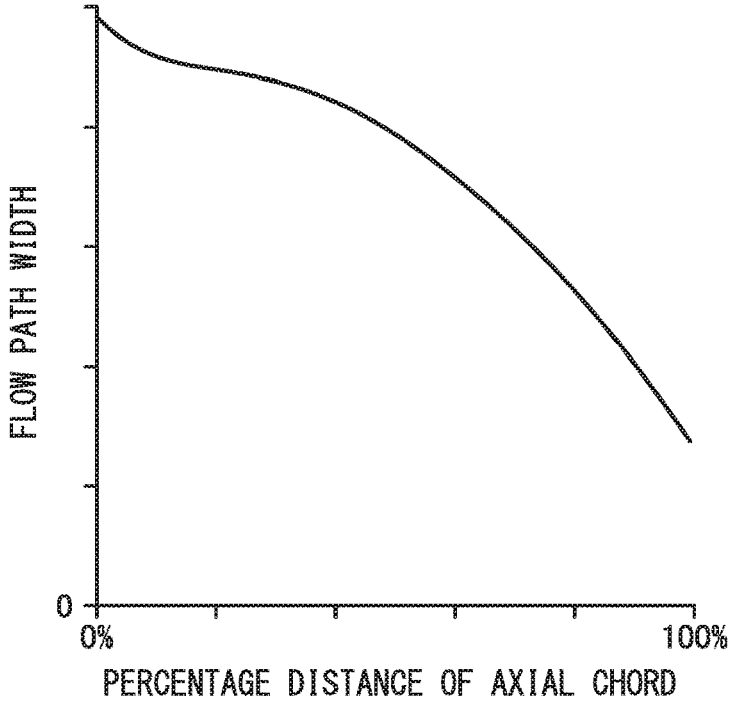
FIG. 5 is a graph showing the relationship between the percentage distance of axial chord and the flow path width at percentage distance of blade height 25% (reference blade height) of the turbine according to the first embodiment of the present invention.

The flow path width W at percentage distance of blade height 25% (that is, the flow path width W at the reference blade height S) changes in the form of the curve that is shown in FIG. 5. In other words, the flow path width W at the reference blade height S only monotonically decreases toward the trailing edge 26 (percentage distance of axial chord 100%) from the leading edge 25 (percentage distance of axial chord 0%) and shows no infinitesimal value. Accordingly, the flow path width W at the reference blade height S shows its minimum value at the trailing edge 26. Accordingly, the flow path width W at the trailing edge 26 is smaller than the flow path width W at the leading edge 25. The flow path width W gently decreases up to a percentage distance of axial chord of approximately 40%, and then it reaches the trailing edge 26 with the degree of its change increased.

The flow path width W at the trailing edge 26 is at its minimum in a range in which the percentage distance of blade height is closer to the tip side than the reference blade height S.

Effects of the turbine 5 will be described below. During driving of the turbine 5, the flow path width W temporarily shrinks, shows its minimum value, and then its diameter (width) increases near the hub endwall 21 of the flow path F between the blade main bodies 20 of the neighboring blades 10. As a result, abrupt flow velocity and pressure fluctuations occur. In the meantime, the flow path width W at the reference blade height S decreases, and thus a shape arises in which the trailing edge 26 side is narrowed down. Accordingly, the flow on the suction side surface 24 of the blade main body 20 is at a sufficient flow rate.

As a result, a flow from the side of the reference blade height S to the hub endwall side is induced on the trailing edge side (refer to arrow R in FIG. 2). In other words, three-dimensional flow rate redistribution is performed for a flow to be induced from the narrow flow path F at the reference blade height S toward the wide flow path F at the hub endwall 21. Accordingly, the flow rate on the trailing edge 26 side of the hub endwall 21 increases, and thus a rapid decline in flow velocity on the suction side surface 24 at the hub endwall 21 can be suppressed.

In the present embodiment, the line of minimum flow path width position m undergoes the transition to the trailing edge 26 side from the hub endwall 21 toward the reference blade height S, and thus the three-dimensional flow rate redistribution described above is performed in the entire range of the flow path width minimum position transition. As a result, the flow in the entire transition range can be optimized, and a rapid decline in the flow velocity on the suction side surface 24 in the region on the hub endwall side can be effectively suppressed.

Figure 6:
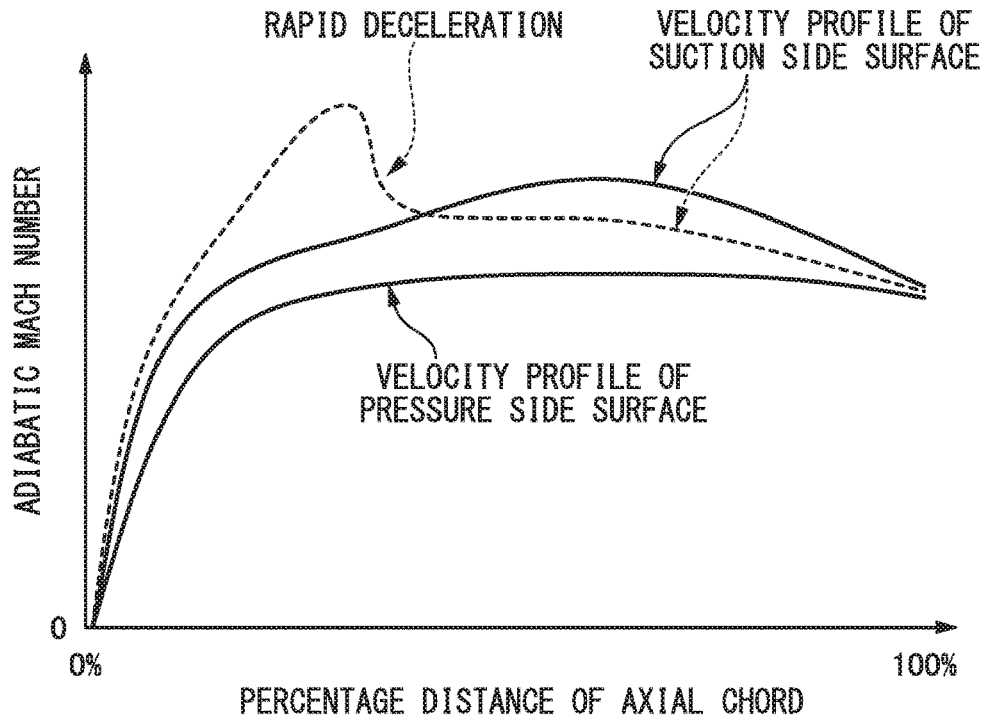
FIG. 6 is a graph showing velocity distributions of a suction side surface and a pressure side surface of the blade of the turbine according to the first embodiment of the present invention.

FIG. 6 shows the results of analyses of respective adiabatic Mach numbers of the pressure side surfaces 23 and the suction side surfaces 24 of the blade main body 20 that has a conventional shape and the blade main body 20 according to the present embodiment. The dashed line represents the analysis result regarding the conventional shape and the solid line represents the analysis result regarding the present embodiment.

As is apparent from the analysis results, a rapid decline in flow speed occurs on the suction side surface 24 in the conventional shape, and it results in deterioration in terms of flow velocity distribution. In the shape according to the present embodiment, in contrast, the flow velocity distribution on the suction side surface 24 improves and no rapid decline in flow rate occurs. This is because a flow from the tip side to the hub endwall 21 is induced on the trailing edge 26 side as described above and, as a result, a fluid passing through the minimum flow path width W at the hub endwall 21 undergoes no rapid deceleration and its flow velocity is stabilized.

According to the present embodiment, the flow velocity at the hub endwall 21 can be stabilized, even in a case where a portion of the profile thickness has been increased for strength to be ensured, as described above. Accordingly, a decline in the efficiency of the turbine 5 as a whole can be suppressed. As a result, the turbine 5 can have a high level of efficiency while its strength is maintained at a high level.

In the present embodiment, the reference blade height S is set at the percentage distance of blade height 25% position. However, the present invention is not limited thereto. The reference blade height S may be set within a percentage distance of blade height range of 5% to 25%.

In the region that falls below 5% of the blade height toward the tip 22 from the hub endwall, the profile thickness near the middle of the axial chord length C is increased for the strength of the blade 10 to be ensured. Accordingly, the reference blade height S is in the region of at least 5% of the blade height H. If the reference blade height S is positioned in the region exceeding 25% of the blade height, the reference blade height S will be excessively separated from the hub endwall 21. Then, effective flow induction from the reference blade height S toward the hub endwall 21 will be impossible.

Accordingly, the strength of the blade 10 can be ensured and induction of a flow to the hub endwall 21 can be effectively performed at the same time by the reference blade height S being set in the percentage distance of blade height range of 5% to 25%.

Hereinafter, a second embodiment of the present invention will be described with reference to FIGS. 7 to 9. The second embodiment differs from the first embodiment in that the shape of the blade main body 20 has been specified in the second embodiment, which shares the same configuration with the first embodiment.

Figure 7:
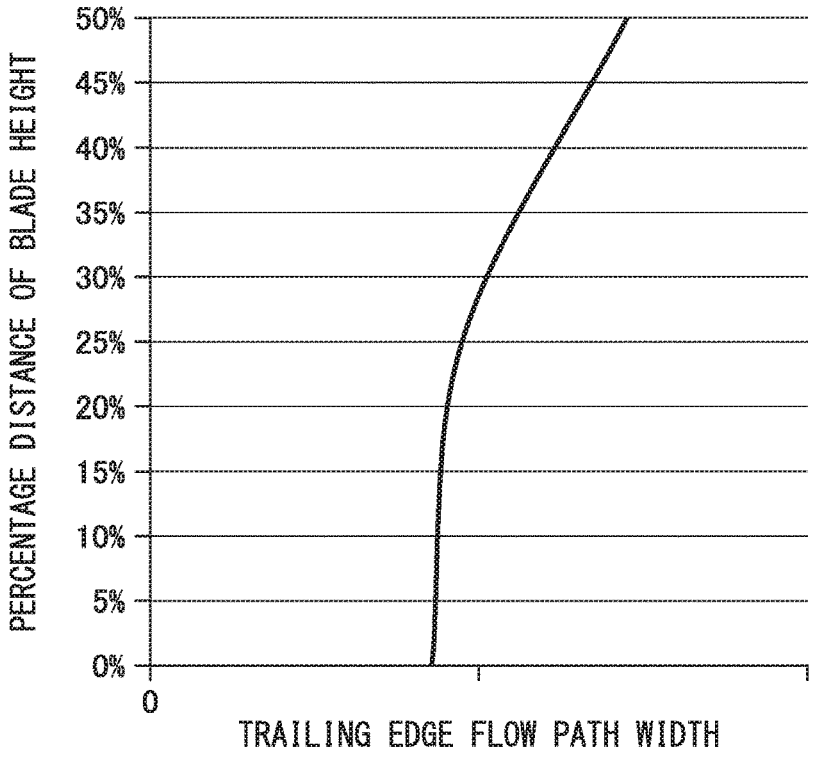
FIG. 7 is a graph showing a relationship between a trailing edge flow path width and a percentage distance of blade height in a flow path of a turbine according to a second embodiment of the present invention.

FIG. 7 shows a relationship between the percentage distance of blade height and the flow path width W of the flow path F at the trailing edge 26 in the turbine 5 according to the second embodiment (hereinafter, simply referred to as the flow path width W at the trailing edge 26). FIG. 7 shows a percentage distance of blade height range of 0 to 50% with regard to this relationship. As shown in FIG. 7, the flow path width W at the trailing edge 26 gently increases, while showing little change, up to percentage distance of blade height 20% from the hub endwall 21 (percentage distance of blade height 0%). Then, it reaches percentage distance of blade height 50% with the rate of its change increased.

Figure 8:
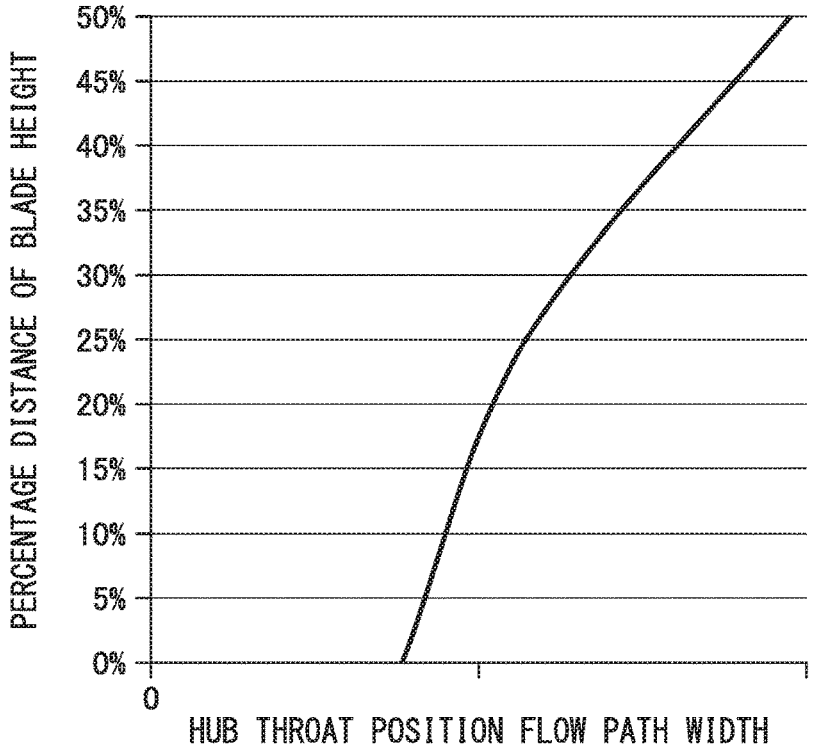
FIG. 8 is a graph showing a relationship between a hub throat position flow path width and the percentage distance of blade height in the flow path of the turbine according to the second embodiment of the present invention.

FIG. 8 shows a relationship between the percentage distance of blade height and a hub throat position flow path width in the flow path F of the turbine 5 according to the second embodiment. FIG. 8 shows a percentage distance of blade height range of 0 to 50% with regard to this relationship.

The hub throat position flow path width means the flow path width W at the same axial chord length ratio position at each blade height position with respect to the axial chord length ratio position where the flow path width W shows its minimum value at the hub endwall 21 of the blade main body 20. As shown in FIG. 2, a line of hub throat position L, which shows a transition of the position of the hub throat position flow path width, extends toward the blade height direction from the position where the flow path width W at the hub endwall 21 shows its minimum value. In a case where the axial chord length ratio position where the flow path width W at the hub endwall 21 shows its minimum value is 30%, for example, the hub throat position flow path width is the flow path width W at the position where the axial chord length ratio position at each blade height position is 30%.

As shown in FIG. 8, the hub throat position flow path width monotonically increases toward the blade height direction from the hub endwall 21, and reaches a percentage distance of blade height of 50%.

Figure 9:
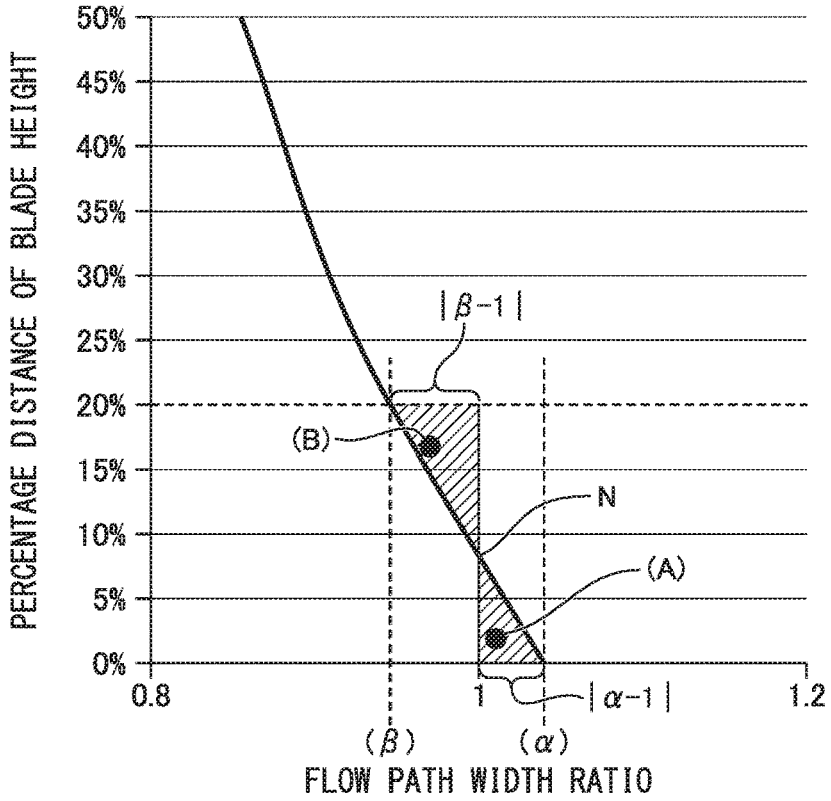
FIG. 9 is a graph showing a relationship between a flow path width ratio and the percentage distance of blade height in the flow path of the turbine according to the second embodiment of the present invention.

FIG. 9 shows a relationship between the percentage distance of blade height and the flow path width ratio in the flow path F of the turbine 5 according to the second embodiment. FIG. 9 shows a percentage distance of blade height range of 0 to 50% with regard to this relationship.

The flow path width ratio means the ratio of the flow path width W at the trailing edge 26 (trailing edge flow path width) to the hub throat position flow path width at each blade height position (trailing edge flow path width/hub throat position flow path width).

As shown in FIG. 9, the flow path width ratio shows a value exceeding 1 at the hub endwall 21 (percentage distance of blade height 0%), monotonically decreases toward the blade height direction, shows 1 directly ahead of percentage distance of blade height 10%, approximately 8% to 9% to be specific, and reaches percentage distance of blade height 50% after monotonically decreasing further toward the blade height direction. In the following description, the percentage distance of blade height where the flow path width ratio is 1 will be referred to as a transition position N. This transition position N is not limited to the 8% to 9% percentage distance of blade height, and may have any value within a percentage distance of blade height of 10%.

At a blade height where the value of the flow path width ratio exceeds 1, the trailing edge side expands, and thus the flow rate becomes insufficient on the trailing edge 26 side. At a blade height where the value of the flow path width ratio falls below 1, the trailing edge side shrinks, and thus the flow rate is sufficient on the trailing edge side. Accordingly, on the trailing edge side, the flow at the blade height where the value of the flow path width ratio falls below 1 is induced to the blade height where the value of the flow path width ratio exceeds 1. By the blade height at the transition position N where the value of the flow path width ratio is 1 being set in a region within 10% of the blade height, the flow can be effectively induced to the blade height where the flow rate is insufficient on the trailing edge side.

In the present embodiment, it is preferable that a relationship of $|\beta-1|>|\alpha-1|$ is established when the maximum value of the flow path width ratio in the region where the percentage distance of blade height is within 10% is defined as the maximum flow path width ratio $\alpha$ and the minimum value of the flow path width ratio in the region where the percentage distance of blade height is within 20% is defined as the minimum flow path width ratio $\beta$.

The geometric meaning of $|\alpha-1|$ and $|\beta-1|$ in FIG. 9 will be described below. When the horizontal axis (flow path width ratio) in FIG. 9 is regarded as an X axis and the vertical axis (percentage distance of blade height) in FIG. 9 is regarded as a Y axis, the maximum flow path width ratio $\alpha$ is a point of intersection between the curve in FIG. 9 and Y=0[%]. Accordingly, $|\alpha-1|$ is the distance between that point of intersection and X=1.

The minimum flow path width ratio $\beta$ is a point of intersection between the curve in FIG. 9 and Y=20[%]. Accordingly, $|\beta-1|$ is the distance between that point of intersection and X=1.

In the region where the flow path width ratio exceeds 1, the flow rate is insufficient, and thus the value of $|\alpha-1|$ correlates with the shortfall in the flow rate in the range of the blade height direction. In the region where the flow path width ratio falls below 1, the flow rate is sufficient, and thus $|\beta-1|$ correlates with the excess of the flow rate. Accordingly, the establishment of the relationship of $|\beta-1|>|\alpha-1|$ means that the flow rate that can be supplied exceeds the shortfall in the flow rate. Accordingly, once the relationship is established, a flow can be effectively induced to the blade height on the trailing edge side where the flow rate is insufficient.

In the present embodiment, it is also preferable that a relationship of B>A is established between the area A of a first region surrounded by the curve X=1 and Y=0[%] in FIG. 9 and the area B of a second region surrounded by the curve X=1 and Y=20[%] in FIG. 9.

In the region where the flow path width ratio exceeds 1, the flow rate is insufficient, and thus the area A occupying a portion of the region where the flow path width ratio exceeds 1 correlates with the shortfall in the flow rate in the range of the blade height direction. In the region where the flow path width ratio falls below 1, the flow rate is sufficient, and thus the area B occupying a portion of the region where the flow path width ratio falls below 1 correlates with the excess of the flow rate. Accordingly, the establishment of the relationship of B>A means that the flow rate that can be supplied exceeds the shortfall in the flow rate. Accordingly, once the relationship is established, a flow can be further effectively induced to the blade height on the trailing edge side where the flow rate is insufficient.

The present invention is not limited to the embodiments described above, and can be appropriately modified without departing from the technical scope of the present invention.

For example, the blade 10 may be applied to any stage of the turbine 5 other than its final stage although it is preferable that the blade 10 is applied to the final stage. Even in this case, a decline in the efficiency of the turbine 5 can be suppressed as described above.

The examples that have been described above assume the application of the blade 10 to the turbine 5 in the gas turbine 1. The turbine 5 may be applied to a rotary machine other than the gas turbine 1 instead.

REFERENCE SIGNS LIST

1 Gas turbine
2 Rotor
3 Compressor
4 Combustor

5 Turbine
6 Casing
7 Vane
10 Blade
20 Blade main body
21 Hub endwall
22 Tip
23 Pressure side surface
24 Suction side surface
25 Leading edge
26 Trailing edge
H Blade height
C Axial chord length
S Reference blade height
m Line of minimum flow path width position
L Line of hub throat position
N Transition position
Axis
U Direction of rotation
R Arrow
W Flow path width
X The position of throat in percentage distance of axial chord at hub endwall

The invention claimed is:

1. A turbine comprising:

a rotor which is capable of rotating about an axis extending in an axial direction; and a plurality of blades attached to the rotor, wherein:

the plurality of blades are arranged in a circumferential direction with respect to the axis, each of the plurality of blades has a blade main body extending radially outward with respect to the axis, the blade main body includes a leading edge, a trailing edge, a hub endwall, and a tip, the leading edge extends in a radial direction with respect to the axis, and is an end of the blade main body on a first radial side of the blade main body, the trailing edge extends in a radial direction with respect to the axis, and is separated from the leading edge in the axial direction, the hub endwall extends in the axial direction, and is a most radially inward portion of the blade main body with respect to the axis, the tip extends in the axial direction, and is a most radially outward portion of the blade main body with respect to the axis, in the blade main body, between the hub endwall and the tip, a position spaced from the hub endwall toward the tip is a reference blade height, a flow path, through which a gas can flow, is formed between a first blade main body and a second blade main body, the first blade main body is the blade main body of a first blade of the plurality of blades, and the second blade main body is the blade main body of a second blade of the plurality of blades that is adjacent to the first blade in the circumferential direction, a width of the flow path between the hub end wall of the first blade main body and the hub end wall of the second blade main body decreases toward a minimum width from the leading edge of the first main body, and increases toward the trailing edge of the first main body from the minimum width, the width of the flow path at the reference blade height of the first blade main body and the second blade main body decreases toward the trailing edge of the first main body from the leading edge of the first blade main body, a position of the minimum value of the width of the flow path between the first blade main body and the second blade main body undergoes a transition to the trailing edges from the hub endwall of the first blade main body toward the tip, and the position of the minimum width of the flow path between the first blade main body and the second blade main body at the reference blade height is at the trailing edge of the first blade main body.

2. The turbine according to claim 1, wherein the reference blade height is located in a range of 5% and 25% of a blade height toward the tip side from the hub endwall.

3. The turbine according to claim 1, wherein:

in a case where a virtual circle that is tangent to each of a pressure side surface and a suction side surface of the first and second blade main bodies is drawn, a diameter of the virtual circle is defined as the flow path width;

the diameter of the virtual circle in contact with the pressure side surface of the trailing edge of the first blade main body is defined as a trailing edge flow path width, the flow path width between a position in the axial direction at the minimum value in the first blade main body and a position in the axial direction at the minimum value in the second blade main body is defined as a hub throat position flow path width in the radial direction, a ratio of the trailing edge flow path width to the hub throat position flow path width in the radial direction is defined as a flow path width ratio, a radial position where a value of the flow path width ratio equals 1 is defined as a transition position, the flow path width ratio gradually decreases toward the tip side from a hub side, and the transition position is positioned in a region not greater than 10% of a blade height toward the tip side from the hub endwall.

4. The turbine according to claim 3, wherein a relationship of $|\beta-1|>|\alpha-1|$ is established when a maximum value of the flow path width ratio in the region within 10% of the blade height toward the tip side from the hub endwall is defined as the maximum flow path width ratio $\alpha$ and the minimum value of the flow path width ratio in a region within 20% of the blade height toward the tip side from the hub endwall is defined as the minimum flow path width ratio $\beta$.

5. The turbine according to claim 3, wherein a relationship of B>A is established between A and B when a curve is created regarding a change in the flow path width ratio with a horizontal axis X regarded as the flow path width ratio and a vertical axis Y regarded as a percentage distance of blade height toward the tip side from the hub side with respect to the blade height, A being an area of a first region surrounded by the curve, X=1 and Y=0% and B being an area of a second region surrounded by the curve, X=1 and Y=20%, and wherein the percentage distance of blade height of the blade main body at the hub endwall is 0% and the blade height of the blade main body at the outermost diameter dimension of the tip is 100%.

6. A gas turbine comprising:

a compressor configured to generate compressed air by compressing air;

a combustor generating configured to generate a combustion gas by combusting the compressed air with a fuel; and the turbine according to claim 1 drivable by the combustion gas.

* * * * *